United States Patent [19]

Klausner

[11] Patent Number: 5,016,327

[45] Date of Patent: May 21, 1991

[54] FOOTWEAR LACING SYSTEM

[76] Inventor: Fred P. Klausner, 768 King Road, Burlington, Ontario, Canada, L7T 3K6

[21] Appl. No.: 514,106

[22] Filed: Apr. 25, 1990

Related U.S. Application Data

[63] Continuation-in-part of Ser. No. 336,343, Apr. 10, 1989.

[51] Int. Cl.[5] ..... A43C 7/00

[52] U.S. Cl. ..... 24/713.3; 24/714.6; 24/442

[58] Field of Search ..... 24/713.3, 713.1, 713.2, 24/713.4, 713.5, 713.6, 713, 714.6, 715.3, 442, 306, 712.4, 712.6; 36/50, 114

[56] References Cited

U.S. PATENT DOCUMENTS

| | | | |
|---|---|---|---|
| 864,774 | 9/1907 | Dumke | 24/713 |
| 1,256,254 | 2/1918 | Peterson | 24/713 |
| 1,450,047 | 3/1923 | Oberg | 36/50 |
| 3,327,410 | 6/1967 | Park, Sr. et al. | 24/442 |
| 4,577,419 | 3/1986 | Chassaing | 36/114 |
| 4,592,154 | 6/1986 | Oatman | 36/50 |
| 4,793,075 | 12/1988 | Thatcher | 36/50 |

FOREIGN PATENT DOCUMENTS

| | | | |
|---|---|---|---|
| 45684 | 1/1911 | Austria | 24/713.6 |
| 354633 | 10/1905 | France | 24/713.3 |
| 619919 | 4/1927 | France | 24/714.6 |
| 1443 | of 1904 | United Kingdom | 24/714.6 |
| 4102 | of 1910 | United Kingdom | 24/713.3 |

*Primary Examiner*—Victor N. Sakran

*Attorney, Agent, or Firm*—Bean, Kauffman & Spencer

[57] ABSTRACT

An improved lacing system for footwear which features a novel flat or rectangular cross section lace, an improved eyelet construction having an essentially straight lace bearing edge which ensures threading of the lace in a flatwise or untwisted manner, a parallel slot frictional engagement means for releasably securing the lace at the toe portion of the footwear and a releasable means for securing the lace at the ankle portion of the footwear.

30 Claims, 3 Drawing Sheets

Fig. 2.
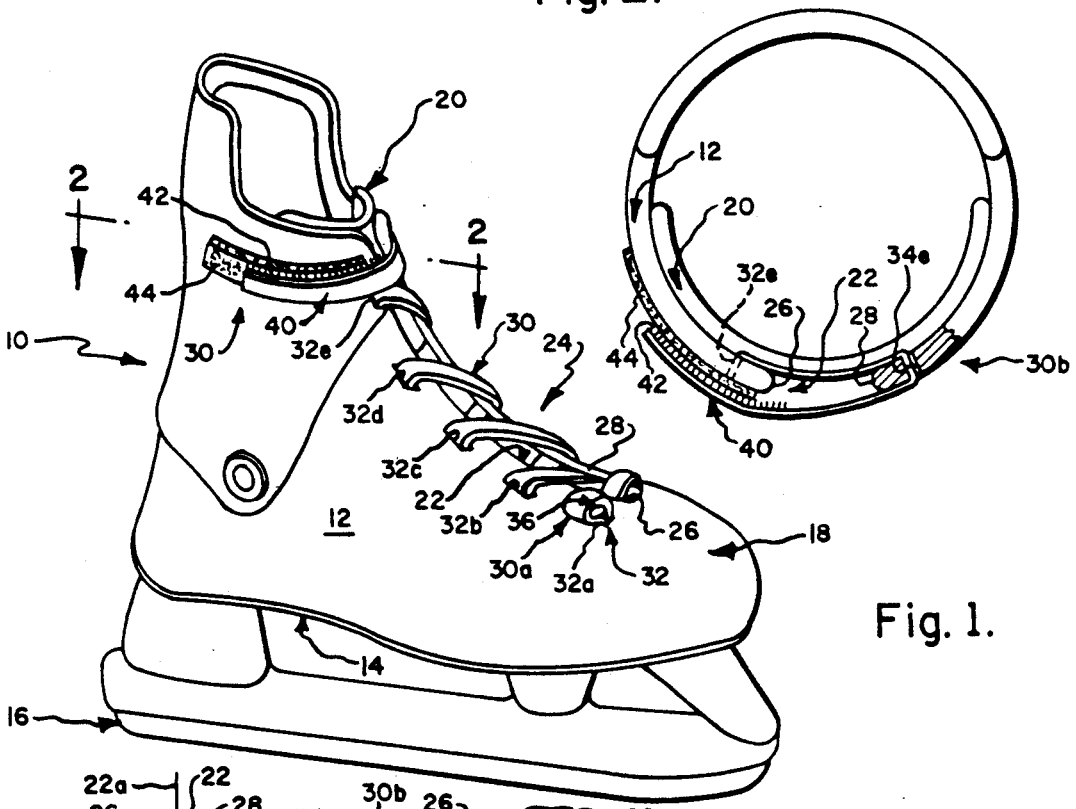
Fig. 1.
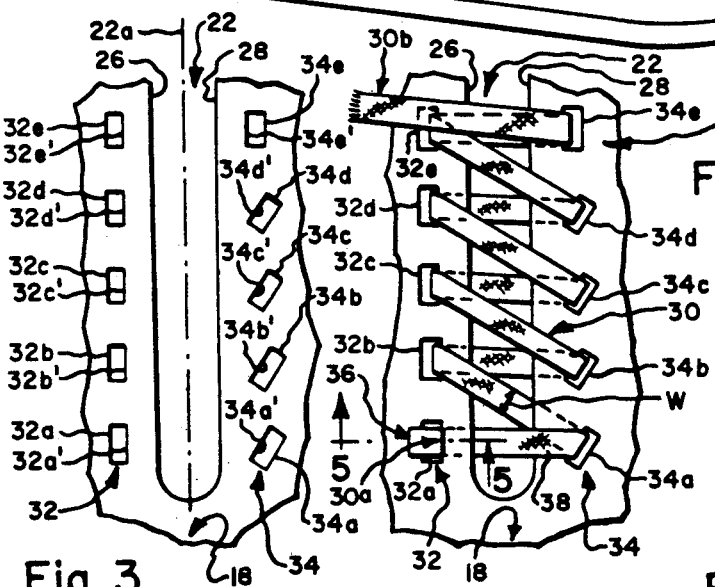
Fig. 3.
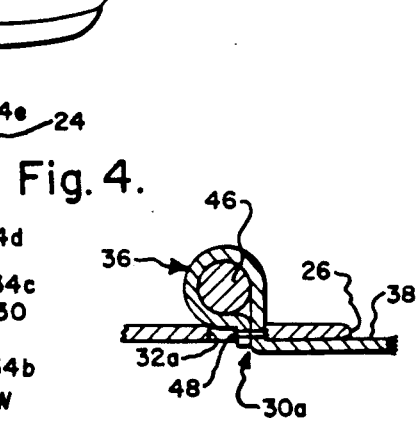
Fig. 4.
Fig. 5.
Fig. 6.
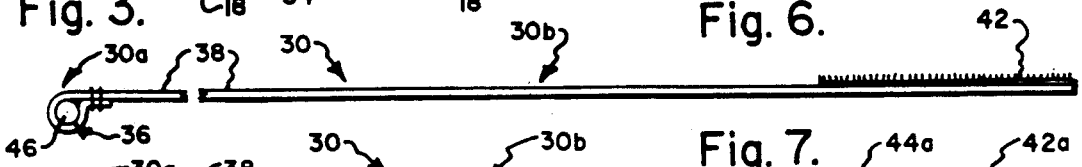
Fig. 7.
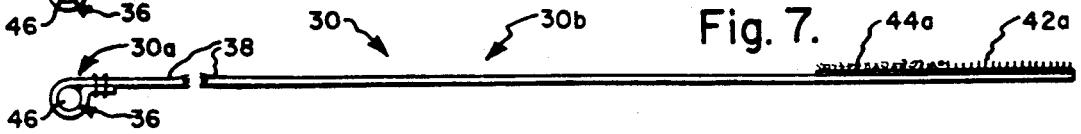

Fig. 8.
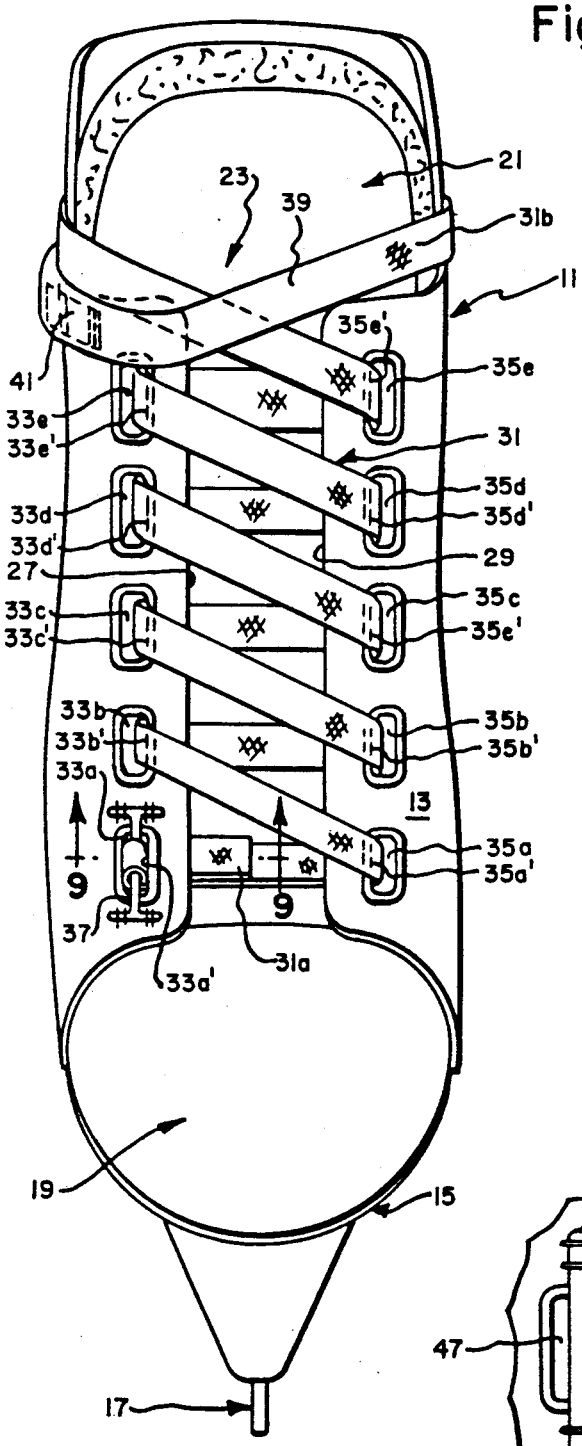
Fig. 13.
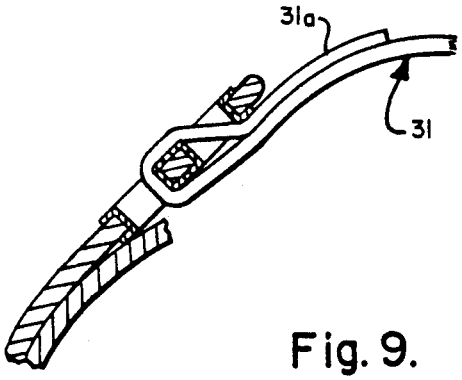
Fig. 9.
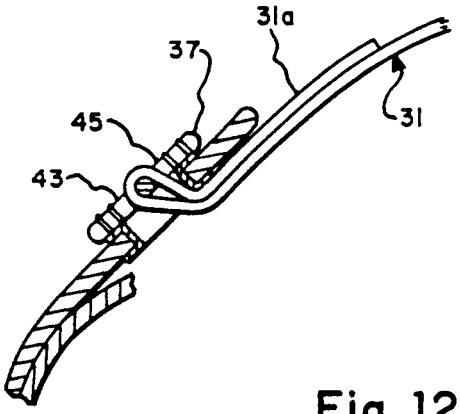
Fig. 12.
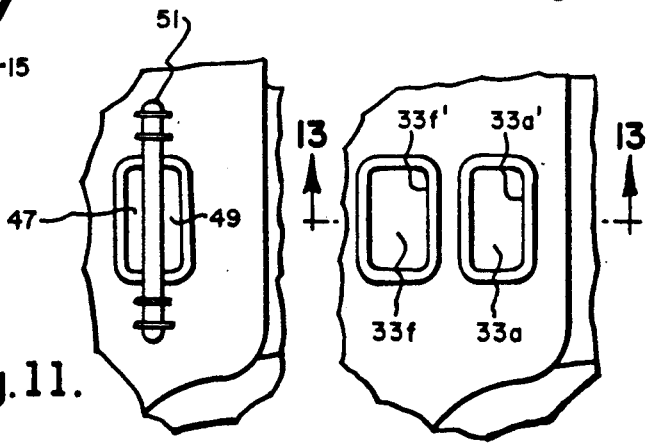
Fig. 11.

Fig. 10.
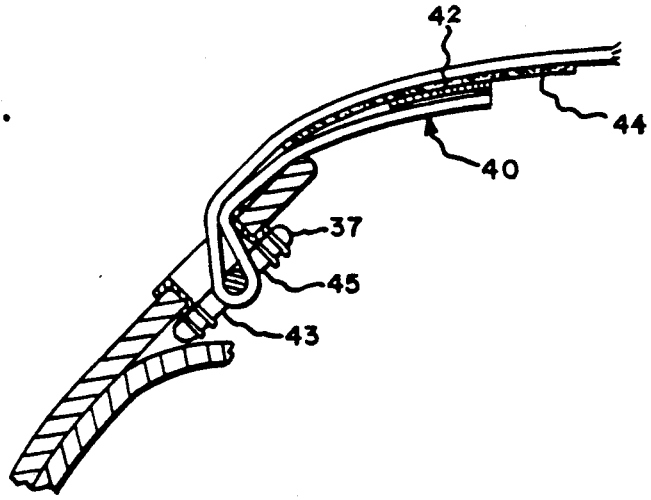
Fig. 14.
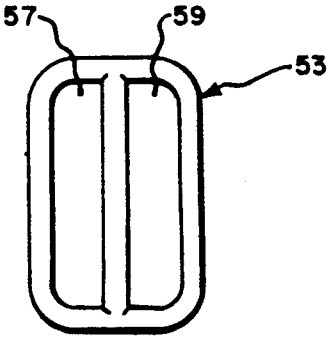
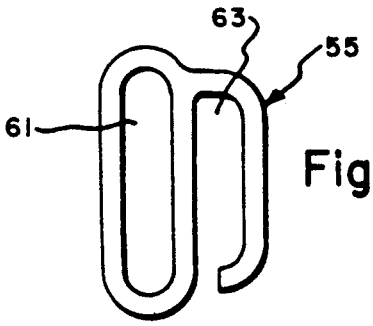
Fig. 15.
Fig. 16.
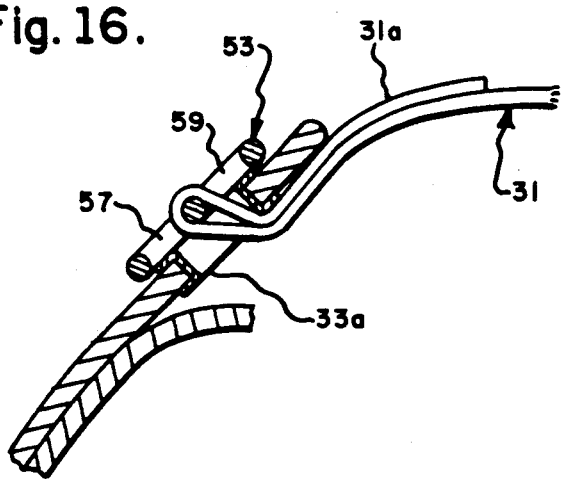
Fig. 17.
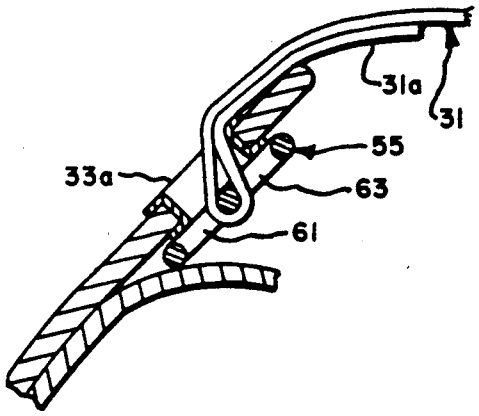

FOOTWEAR LACING SYSTEM

This application is a continuation-in-part of U.S. application Ser. No. 07/336,343 filed Apr. 10, 1989.

BACKGROUND OF THE INVENTION

The invention generally relates to a lacing system for footwear of the type having eyelets through which a lace is passed and subsequently secured for purposes of retaining the footwear in snug engagement with a wearer's foot.

In a typical footwear lacing system, rows of eyelets of circular configuration are disposed along opposite sides of a slot, which is provided in an upper of the footwear and arranged to extend rearwardly of a toe portion of the footwear in overlying relation to a tongue. A lace of desired cross section, such as round, oval or rectangular, is threaded through the eyelets typically from a point adjacent the toe portion and finally tied in a knot at a point typically adjacent the upper foot to maintain a desired tension in the lace and resultant snugness of the footwear against a wearer's foot.

A problem with this typical system is that portions of the lace crisscrossing between the rows of eyelets apply pressure to discrete portions of the tongue, which prove uncomfortable to the wearer whenever tension applied to the lace exceeds some predetermined value, depending for instance upon the degree of padding of the tongue. A further problem with the typical lacing system is that laces are time consuming to tie, tend to loosen over time and tend to so reduce diameter under stress as to cut into hands during tightening.

Certain problems encountered with a typical lacing system are overcome in part by lacing systems disclosed in U.S. Pat. Nos. 4,150,949 and 4,592,154, wherein flat lace elements of rectangular cross section serve to spread pressure forces, applied to the tongue, over a greater area in order to minimize discomfort to a wearer. These patents also seek to avoid the problems associated with tying of a lace by providing a fastener or fasteners for releasable connecting opposite ends of the lace. These lacing systems do not appear to enjoy wide commercial use and there appears to be a continuing need for an improved lacing system for flat or rectangular cross section lace elements.

SUMMARY OF THE INVENTION

The present invention discloses an improved lacing system for footwear which features a novel flat or rectangular cross section lace, an improved eyelet construction which ensures threading of the lace in a flatwise or untwisted manner and an improved system for releasably securing the lace to the footwear.

A lace formed in accordance with the present invention comprises an elongated strip of material of generally rectangular cross section having a first end for releasable attachment adjacent the toe portion of footwear, a second end sized for insertion or threading through eyelets of the footwear and being provided with releasably interlocking means such as may be defined by the hook and loop surfaces of "Velcro" type fasteners Preferably, a surface of the lace at the second end comprises a hook and/or loop Velcro type fastener arranged to interlock with an appropriate positioned hook and/or loop Velcro fastener on the footwear. A surface of the lace at the toe portion may have alternately spaced Velcro type fasteners for improving frictional engagement of the lace thereat. The length of the lace is sufficient to permit the second end to be threaded through the eyelets beginning adjacent a toe portion of the footwear and typically is sufficient to subsequently be wound around the ankle, foot or the like of a wearer and thereafter engage the footwear for retention purposes.

The improved eyelet construction includes two rows of eyelets arranged along opposite sides of a slot provided in an upper, wherein the eyelets of the rows are preferably transversely aligned and formed with essentially straight lace bearing edges having a length at least equal to the widthwise dimension of the lace. The lace bearing edges of the eyelets of a first row are preferably disposed essentially parallel to one another and the slot. The lace bearing edges of the eyelets of a second row can be arranged as the first row, or, are preferably arranged in a divergent relationship relative to the lace bearing edges of their transversely associated eyelets of the first row in a direction away from the toe portion of the footwear. The lace bearing edge of the eyelets in the second row nearest and furthermost from the toe portion, in one embodiment are preferably disposed essentially parallel to the lace bearing edge of its transversely associated eyelet and the slot.

Releasable attachment means, preferably parallel slot frictional engagement means is provided, at an eyelet in the first or second row adjacent the toe portion, for releasably fixing a first end of the lace to the boot. Releasable attachment means can comprise an enlargement or stop of a size sufficient to prevent passage of a first end portion of the lace through an eyelet and can comprise parallel slot engagement means. By parallel slot frictional engagement means is meant that the lace is interwoven through two or more parallel slots such that the lace frictionally engages upon itself to prevent slipping through the eyelet. Such means may include dividing an eyelet into adjacent parallel slots, two or more adjacent parallel eyelets, or, can comprise separate clip means having parallel slots, through which the first end of the lace may be woven for frictional engagement of the lace upon itself to provide releasable fixing of the lace to an eyelet of the footwear adjacent the toe portion Placement of Velcro type fastener arrangements on a side of the lace at the toe portion can improve the frictional engagement of the lace thereat.

BRIEF DESCRIPTION OF THE DRAWINGS

The nature and mode of operation of the present invention will now be more fully described in the following detailed description taken with the accompanying drawings wherein:

FIG. 1 is a perspective view of a hockey skate incorporating a system of the present invention;

FIG. 2 is a sectional view taken generally along the line 2—2 in FIG. 1 and showing a hook and loop arrangement for fastening an end of the lace to the skate;

FIG. 3 is a fragmentary plan view showing the eyelets of the skate of FIG. 1, but without a lace threaded therethrough;

FIG. 4 is a view similar to FIG. 3, but showing a lace threaded the eyelets;

FIG. 5 is an enlarged sectional view taken generally along the line 5—5 in FIG. 4 showing a stitched filled stop attachment means;

FIGS. 6 and 7 are fragmentary edge views showing alternate hook and loop, lace constructions;

FIG. 8 is a perspective view of a hockey skate incorporating a further embodiment of the lacing system of the present invention, FIG. 9 is an enlarged sectional view taken generally along the line 9—9 in FIG. 8 with lace threaded therethrough;

FIG. 10 is a view similar to FIG. 9, showing an alternate threading of the lace therethrough;

FIG. 11 is an enlarged fragmentary plan view showing a further alternate configuration of an eyelet of a hockey skate having parallel slot frictional engagement means;

FIG. 12 is an enlarged fragmentary plan view showing two generally parallel rectangular eyelets configured as frictional engagement means;

FIG. 13 is an enlarged sectional view taken along the line 13—13 of FIG. 12, showing two generally parallel, rectangular eyelets of the hockey skate with lace threaded therethrough;

FIGS. 14 and 15 are plan views of frictional engagement clips representing alternate constructions of the frictional engagement means.

FIG. 16 is a sectional view representing a frictional engagement lacing arrangement applicable for the means of FIGS. 14 and 15.

FIG. 17 is a sectional view representing a further frictional engagement lacing arrangement applicable for the means of FIGS. 14 and 15.

DETAILED DESCRIPTION

It will be understood at the outset that the lacing system of the present invention possesses utility in securing diverse types of footwear to the foot of a user. However, in order to facilitate description of the present invention, specific reference will now be made to its use in association with a conventional hockey skate which is identified as 10 in FIG. 1 and 13 in FIG. 8. FIG. 1 illustrates skate 10 as generally including an upper 12 secured to a sole 14 from which depends a skate blade 16. Upper 12 is depicted as including a toe portion 18; a tongue 20, which is secured to the toe portion and extending rearwardly thereof to overlie the top portion of the foot of a user, not shown; and, a slot 22 arranged to extend lengthwise of the upper from adjacent the rear of the toe portion in overlying relation to the tongue.

FIG. 8 illustrates skate 13 as generally including an upper 11 secured to a sole 15 from which depends a skate blade 17. Upper 11 is depicted as including a toe portion 19; a tongue 21, which is secured to the toe portion and extending rearwardly thereof to overlie the top portion of the foot of a user, not shown; and, a slot 23 arranged to extend lengthwise of the upper from adjacent the rear of the toe portion in overlying relation to the tongue.

The lacing system of the present invention, which is designated as 24 in FIG. 1 is conventional from the standpoint that it is employed to releasably draw together the opposite edges 26, 28 of slot 22 and 27, 29 of slot 23 for purposes of snugly securing upper 12, 11 about the foot of a user and in that it includes a lace intended to be passed or threaded through suitably defined eyelets or apertures arranged to define two rows of eyelets and extending one row along each of edges 26, 28 and 27, 29 respectively. The number of eyelets provided in each row is a matter of choice depending on the type of footwear with which the lacing system is to be employed, but for example in the case of footwear wherein it is required to offer support for the ankle of a user, as would be the case of hockey skates 12, 13, four and preferably five or more eyelets may be found satisfactory, as indicated at eyelets 32*a*–32*e* and 34*a*–34*e* in FIG. 1 and eyelets 33*a*–33*e* and 35*a*–35*e* in FIG. 8.

Laces 30, 31 are shown in the drawings as being in the form of elongated relatively thin strips of a suitable material, such as for instance a woven fabric or other pliable material such as plastic or leather, which is flat or characterized as having a generally rectangular cross sectional configuration. Lace 31 is considered as having first end portion 31*a*, which is provided with a frictional engagement means depicted generally as 37 in FIGS. 8–10 for releasably attaching such first end portion to hockey skate 11 in the manner to be described; and second end portion 31*b*, which is provided on lace surface 39 with suitable releasably interlocking or securing means 42, such as may be defined by patches of hook and loop defining materials, respectively, of the type well known in the art and sold under the trademark "Velcro". Provided at 41 of upper 11 is correspondingly arranged interlocking or securing means 44. It should be understood that any suitable combination of hook and loop surfaces correspondingly arranged between second end portion 31*b* and the upper of the skate is contemplated as being within the scope of the invention.

FIG. 10 depicts an embodiment comprising an alternate lace threading, wherein first end portion 31*a* of lace 31 comprises securing means 42 and 44 arranged in an offset relation on the same side for improving frictional engagement. Similarly, Lace 30 is considered as having first end portion 30*a*, which is provided with attachment stop means depicted generally as 36 in FIGS. 1–7 for releasably attaching such first end portion to hockey skate 12 in the manner to be described; and second end portion 30*b*, which is provided on its surface 38 with suitable releasably interlocking or securing means 42. Provided at 40 of upper 10 is correspondingly arranged interlocking or securing means 44. Securing means 42 and/or 44 may also be arranged in an offset, overlapping relation respectively.

As shown in FIGS. 1 and 8, eyelets 32*a*–32*e*, 34*a*–34*e*, 33*a*–33*e* and 35*a*–35*e* are characterized as having essentially straight lace bearing edges 32*a*'–32*e*', 34*a*'–34*e*', 35*a*'–35*e*'and 33*a*'–33*e*', whose lengths are at least equal to the widthwise dimension of laces 30 and 31, as measured transversely of surfaces 38 or 39 and as being of a size/configuration sufficient to permit threading of second end portion 30*b*, 29*b* therethrough. Otherwise, the size/configuration of the eyelets are matters of choice. The eyelets of one or a first of such rows, such as eyelets 32*a*–32*e*, are preferably arranged such that their bearing edges 32*a*'–32*e*' are disposed essentially parallel to slot 22. Eyelets 34*a*–34*e* of the other or a second of such rows can be similarly arranged as illustrated in FIG. 8 wherein eyelets 35*a*–35*e* and 33*a*–33*e* are depicted as being disposed essentially along parallel lines. Eyelets of the other or a second of such rows can be arranged as in FIGS. 2–3, such that bearing edges 34*a*'–34*d*' diverge relative to slot 22 and their transversely associated bearing edges 32*a*'–32*d*', respectively, in a direction away from toe portion 18, and bearing edge 34*e*' is disposed essentially parallel to slot 22 and its associated bearing 32*e*'. In the illustrated construction wherein slot edges 26, 28 are shown as being essentially straight and parallel, rows 32 and 34 may also be essentially straight and parallel, and their respective eyelets may be essentially aligned in a direction extending transversely of slot 22. This illustrated arrangement is, however, not limiting on the invention, since it is known to provide footwear in which rows of eyelets diverge in a direction away from toe portion 18, or in which rows of eyelets are not straight. Moreover, it is contemplated that some or all of eyelets 34*a*–34*e* need not be disposed in transverse alignment with eyelets 32*a*–32*e*. However, the illustrated eyelet arrangement of FIG. 1 is preferred in that it allows the portions of lace 30 disposed alternately in engagement with tongue portion 18 to be arranged in a parallel relationship and extend transversely thereof in order to provide for the application of pressure to the tongue portion in a relatively uniform manner.

Attaching means 36 shown in FIG. 5 is defined by folding over and stitching 48 first end portion 30*a* about a filler 46 in order to create an enlargement or stop of a size sufficient to prevent passage of the first end portion through aperture 32*a*, during the lacing operation to be described. However, if desired, attaching means 36 may be otherwise defined, such as by being one part of a two part interlocking fastener whose other part is carried by upper 10. Thus, as by way of further example, first end portion 30*a* and upper 10 may be fitted with corresponding patches of hook and loop defining material of the type referred to above.

Frictional engagement means 37 is shown in FIGS. 9–10 as being generally an eyelet with an "H" shaped, rigid member arranged thereover dividing the eyelet into two parallel slots 43 and 45 through which first end portion 31*a* is interwoven to create a frictionally engaging stop sufficient to prevent passage of the first end portion through the slots during the lacing operation. However, the frictional engaging means may be otherwise configured, such as illustrated in FIG. 11 wherein the engagement means is illustrated as being a single bar attached to the footwear in such manner as to divide an eyelet into two parallel slots 47 and 49; FIG. 12 wherein the engagement means comprises two separate, generally rectangular, generally parallel eyelets 33*a* and 33*f* having lace bearing edges 33*a*' and 33*f* respectively; and, FIGS. 14 and 15 wherein the engagement means comprises clips 53 and 55 having two generally parallel slots 57, 59 and 61, 63 respectively.

The lace is preferably not permanently attached to the engagement means such as for example by stitching together the end of the lace to a portion of the lace interwoven through the frictional engagement means but it should be understood that such configuration is contemplated as being within the broad scope of the invention. Alternately, the lace may comprise hook and loop arrangement to improve frictional engagement at the frictional engagement means.

In operation using a parallel slot frictional engagement means, the free end of lace end portion 31*b* is threaded first through eyelet 33*a*, around the center bar of the frictional engagement means and back through the eyelet such that the free end of the lace is underneath the body of the lace in frictional engagement therewith. Thereafter, the lace is threaded in succession through eyelets 35*a*, 33*b*, 35*b*, 33*c*, 35*c*, 33*d*, 35*d*, 33*e* and 35*e* as shown in FIG. 8. The lacing operation using other releasable attachment means is closely similar. During and/or after this lacing operation, lace end 30*a*, 31*a* is drawn into engagement with the outer surface of upper 10, 11 adjacent eyelet 32*a*, 33*a* as shown in FIGS. 1 and 8 respectively, and second end portion 30*b*, 31*b* is tensioned as required to draw slot edges 26, 28 and 27, 29 towards one another and provide for a desired degree of snugness of the upper against the foot of the user. During lacing, care is exercised to ensure that second end portion 30*b*, 31*b* is not twisted in passing between rows of eyelets 32, 33 and 34, 35 such that surfaces 38, 39 and 40, 41 alternatively lie flatwise against tongue 20, 21 in order to distribute pressure generated by tensioning of lace 30, 31. Thereafter, lace 30, 31 is "tied" or secured in tensioned condition by wrapping the free end of second end portion 30*b*, 31*b* around the ankle or lower leg of the user to bring securing means 42, 42*a* and/or 44, 44*a* into engagement with corresponding securing means 42 and/or 44 appropriately arranged on the footwear, as exemplified in FIGS. 1 and 8.

Alternatively, for the case of hockey skates 10, 11 second end portion 30*b*, 31*b* may, if desired, be wrapped around upper 12, 13 and sole 14, 15 and then upon corresponding securing means for "tying"or securing purposes.

The overall length of laces 30, 31 will vary dependent upon the type of footwear with which it is employed, but in any event must be sufficient to permit both lacing and securing thereof in the manner described. In like manner, the width of lace 30, 31 may be varied, as desired, so long as an essentially line contact between the lace and tongue 20, 21 is avoided, but preferably, the width would exceed about ⅜ inch, and for the case of a hockey skate, preferably exceed about ½ inch in view of the degree of tension normally required to firmly retain a hockey skate in engagement with a foot.

What is claimed is:

1. In footwear of the type having an upper adapted to be snugly engaged with the foot of a user wherein a lace is passed through eyelets of said upper, which eyelets are arranged in two rows placed on opposite sides of a slot defined by said upper and extend rearwardly of a toe portion toward an ankle portion thereof, and said lace is tensioned to draw opposite sides of the slot toward one another and releasably secured for releasably maintaining said tension, the improvement comprising; an upper with eyelets having essentially straight lace bearing edges; lace bearing edges of eyelets in one row arranged in a divergent relationship with transversely associated eyelets in the other row, in a direction away from the toe portion of the footwear; a lace in the form of an elongated strip of material of generally rectangular cross section, dimensioned to generally pull through said eyelets and having first and second end portions; means for releasably attaching said first end portion of said lace at an eyelet adjacent the toe portion of said footwear sufficient to prevent pulling said first end portion through the eyelet; hook and loop means for releasably attaching said second end portion of said lace, to the upper of said footwear, sufficient to prevent pulling said second end portion through said eyelets.

2. The improvement according to claim 1 comprising a lace with a first end portion having a surface provided with a releasable hook and loop interlocking means for releasably securing said end portion to the footwear.

3. The improvement according to claim 1 wherein said lace is of a length sufficient for threading through said eyelets of said rows and thereafter to permit wrapping the second end portion thereof about the ankle or the foot of said user and position the hook and loop releasable interlocking means on a surface of said upper in interlocking engagement.

4. The improvement according to claim 1, wherein said eyelets are transversely aligned.

5. The improvement according to claim 1, wherein said means for releasably attaching said first end portion is an enlargement sized to prevent passage of the first end portion through said eyelets.

6. The improvement according to claim 1, wherein said means for releasably attaching said first end portion comprises a parallel slot frictional engagement means, through which said first end portion of said lace is passed.

7. The improvement according to claim 6 wherein said parallel slot engagement means comprises adjacent parallel eyelets with essentially straight lace bearing edges.

8. The improvement according to claim 6 wherein said parallel slot engagement means comprises a bar positioned at an eyelet, said bar having an essentially straight lace bearing edge which is parallel to an essentially straight lace bearing edge of the eyelet and positioned to divide the eyelet into two slots having essentially straight lace bearing edges.

9. The improvement according to claim 8 wherein said bar comprises a cross member on an end for attachment to the upper.

10. The improvement according to claim 6 wherein said parallel slot engagement means is a clip comprising two generally parallel slots having adjacent, generally parallel, essentially straight lace bearing edges.

11. The improvement according to claim 1, wherein said eyelets are each provided with essentially straight lace bearing edges of a length at least equal to a widthwise dimension of said lace.

12. The improvement according to claim 11, wherein said bearing edges of eyelets are arranged to permit said lace to be passed back and forth between said rows of eyelets without twisting of said lace lengthwise thereof.

13. The improvement according to claim 1, wherein said lace bearing edges of eyelets of one of said rows are essentially parallel to a line extending lengthwise of said slot rearwardly of said tow portion and lace bearing edges of eyelets of the other of said rows diverge relative to said line in a direction rearwardly of said toe portion except that a lace bearing edge of one of said eyelets of said other of said rows disposed farthest from said toe portion is disposed essentially parallel to said line.

14. In a hockey skate of the type having an upper provided with a toe portion, a slot extending rearwardly of said toe portion and eyelets arranged in two rows of eyelets extending along opposite sides of said slot for receiving a lace adapted upon tensioning thereof to draw said opposite sides towards one another, the improvement comprising: an upper with eyelets having essentially straight lace bearing edges; a lace in the form of an elongated strip of material of generally rectangular cross section, dimensioned to generally pull through said eyelets and having first and second end portions; lace bearing edges of eyelets in one row arranged in a divergent relationship with transversely associated eyelets in the other row, in a direction away from the toe portion of the footwear; means for releasably attaching said first end portion of said lace at an eyelet adjacent the toe portion of said footwear sufficient to prevent pulling said first end portion through the eyelet; hook and loop means for releasably attaching said second end portion of said lace, to the upper of said footwear, sufficient to prevent pulling said second end portion through said eyelets.

15. The hockey skate of claim 14 wherein said bearing edges of said eyelets of one of said rows are disposed essentially parallel to a line extending lengthwise of said slot rearwardly of said toe portion, and said bearing edges of said eyelets of the other of said rows diverging relative to said line in a direction rearwardly of said toe portion except for that one of said eyelets of said other of said rows disposed farthest from said toe portion, said bearing edge of said that one of said eyelets being disposed essentially parallel to said line.

16. The improvement according to claim 15, wherein said means for releasably attaching said first end portion is an enlargement sized to prevent passage of the first end portion through said eyelets.

17. In footwear of the type having an upper adapted to be snugly engaged with the foot of a user wherein a lace is passed through eyelets of said upper, which eyelets are arranged in two rows placed on opposite sides of a slot defined by said upper and extend rearwardly of a toe portion toward an ankle portion thereof, and said lace is tensioned to draw opposite sides of the slot toward one another and releasably secured for releasably maintaining said tension, the improvement comprising; an upper with eyelets having essentially straight lace bearing edges; a lace in the form of an elongated strip of material of generally rectangular cross section, dimensioned to generally pull through said eyelets and having first and second end portions; parallel slot frictional engagement means through which said first end portion of said lace is passed for releasably attaching said first end portion of said lace at an eyelet adjacent the toe portion of said footwear sufficient to prevent pulling said first end portion through the eyelet; hook and loop means for releasably attaching said second end portion of said lace, to the upper of said footwear, sufficient to prevent pulling said second end portion through said eyelets.

18. The improvement according to claim 17 comprising a lace with a first end portion having a surface provided with a releasable hook and loop interlocking means for releasably securing said first end portion to said parallel slot frictional engagement means.

19. The improvement according to claim 17 wherein said lace is of a length sufficient for threading through said eyelets of said rows and thereafter to permit wrapping the second end portion thereof about the ankle or the foot of said user and position said hook and loop releasable interlocking means on a surface of said upper in interlocking engagement.

20. The improvement according to claim 17, wherein said eyelets are transversely aligned.

21. The improvement according to claim 17 wherein said parallel slot engagement means comprises adjacent parallel eyelets with essentially straight lace bearing edges.

22. The improvement according to claim 17 wherein said parallel slot frictional engagement means comprises a bar positioned at an eyelet, said bar having an essentially straight lace bearing edge which is parallel to an essentially straight lace bearing edge of the eyelet and positioned to divide the eyelet into two slots having essentially straight lace bearing edges.

23. The improvement according to claim 22 wherein said bar comprises a cross member on an end for attachment to the upper.

24. The improvement according to claim 17 wherein said parallel slot frictional engagement means is a clip comprising two generally parallel slots having adjacent, generally parallel, essentially straight lace bearing edges.

25. The improvement according to claim 17, wherein said eyelets are each provided with essentially straight lace bearing edges of a length at least equal to a widthwise dimension of said lace.

26. The improvement according to claim 17, wherein said lace bearing edges of eyelets of one of said rows are essentially parallel to a line extending lengthwise of said slot rearwardly of said toe portion and lace bearing edges of eyelets of the other of said rows diverge relative to said line in a direction rearwardly of said toe portion except that a lace bearing edge of one of said eyelets of said other of said rows disposed farthest from said toe portion is disposed essentially parallel to said line.

27. In a hockey skate of the type having an upper provided with a toe portion, a slot extending rearwardly of said toe portion and eyelets arranged in two rows of eyelets extending along opposite sides of said slot for receiving a lace adapted upon tensioning thereof to draw said opposite sides towards one another, the improvement comprising: an upper with eyelets having essentially straight lace bearing edges; a lace in the form of an elongated strip of material of generally rectangular cross section, dimensioned to generally pull through said eyelets and having first and second end portions; parallel slot frictional engagement means through which said first end portion of said lace is passed for releasably attaching said first end portion of said lace at an eyelet adjacent the toe portion of said footwear sufficient to prevent pulling said first end portion through the eyelet; hook and loop means for releasably attaching said second end portion of said lace, to the upper of said footwear, sufficient to prevent pulling said second end portion through said eyelets.

28. The improvement according to claim 27 wherein said parallel slot engagement means is a clip comprising two generally parallel slots having adjacent, generally parallel, essentially straight lace bearing edges.

29. The improvement according to claim 27 wherein said parallel slot engagement means comprises adjacent parallel eyelets with essentially straight lace bearing edges.

30. The improvement according to claim 27 wherein said parallel slot engagement means comprises a bar positioned at an eyelet, said bar having an essentially straight lace bearing edge which is parallel to an essentially straight lace bearing edge of the eyelet and positioned to divide the eyelet into two slots having essentially straight lace bearing edges.

* * * * *